United States Patent [19]

Mitrofanov

[11] Patent Number: 4,684,806

[45] Date of Patent: Aug. 4, 1987

[54] RHENIUM LINED GEIGER-MUELLER TUBE

[76] Inventor: Nicholas M. Mitrofanov, 7911 Newport Ave., Parma, Ohio 44129

[21] Appl. No.: 729,356

[22] Filed: May 1, 1985

[51] Int. Cl.[4] ..... H01J 47/08

[52] U.S. Cl. ..... 250/374; 250/375; 313/93

[58] Field of Search ..... 250/374, 375; 313/93

[56] References Cited

U.S. PATENT DOCUMENTS

| | | | |
|---|---|---|---|
| 3,342,538 | 9/1967 | Mitrofanov | 445/56 |
| 3,892,990 | 7/1975 | Mitrofanov | 313/93 |
| 4,359,661 | 11/1982 | Mitrofanov | 313/93 |
| 4,501,988 | 2/1985 | Mitrofanov et al. | 313/93 |

*Primary Examiner*—Janice A. Howell
*Assistant Examiner*—Constantine Hannaher
*Attorney, Agent, or Firm*—Fay, Sharpe, Beall, Fagan, Minnich & McKee

[57] ABSTRACT

A Geiger-Mueller tube includes a tubular, stainless steel cathode (A) which defines a chamber (B) therein. An anode (C) extends axially through the chamber in a spaced relationship with the cathode. A thin layer of rhenium (20) is plated on an interior surface (12) of the cathode. End caps (32, 36) and ceramic fittings (34, 38) hermetically seal the ends of the cathode tube. The cathode chamber is charged with a gaseous mixture including in primary part noble gases, such as neon and argon, and about 1-3% bromine or other halogen gases. The Geiger-Mueller tube with a rhenium plated cathode is relatively inexpensive to manufacture, provides excellent bromine and halogen degradation resistance at elevated temperatures, and provides superior, linear operating characteristics over a wide range of temperatures.

10 Claims, 3 Drawing Figures

RHENIUM LINED GEIGER-MUELLER TUBE

BACKGROUND OF THE INVENTION

The present invention relates to a method and apparatus for radiation detection. It finds particular application in improving the performance of Geiger-Mueller tubes and counters and will be described in conjunction therewith.

Geiger-Mueller tubes have commonly included a gas filled cylindrical metal cathode and a fine wire anode extending axially therethrough. The gas is typically a noble gas, such as argon or neon, which is ionized by a particle passing therethrough causing a uniform discharge between the cathode and anode. The noble gas is mixed with a quench gas which inhibits secondary ionization. Common quench gases include chlorine and bromine which, of course, are highly corrosive to many metals.

Geiger-Mueller tubes find utility in numerous fields. For example, Geiger-Mueller tubes have been used to monitor sources of naturally occuring or artificially introduced radiation. In one application, the radiation from radioactive tracers is introduced into the human body or other biological tissue to monitor the movement or absorption of the tracer therethrough. In another application, the monitored radiation from artifically activated substances is used or introduced into various chemical processing systems, mechanical parts, or the like. Monitoring the radiation from the activated substance indicates the progress of chemical reactions, the movement or migration of the activated substance, the removal, or wear, or erosion of the activated substance, or the like. In yet another application, natural radiation is detected in prospecting for naturally radioactive substances, and the like.

Geiger-Mueller tubes have also been utilized in conjunction with a dedicated radiation source, such as a gamma radiation source, for monitoring a physical substance thereadjacent. For example, accurate measurements are made of the flow rate of oil or fuel flowing through a tube disposed between the radiation source and the Geiger-Mueller tube. As another example, the thickness of sheet goods passing between the source of radiation and Geiger-Mueller tubes is measured. In well logging, the radiation source irradiates surrounding strata and the Geiger-Mueller tube detects reflected and secondary radiation emanating from the surrounding walls of the well.

Although the prior art Geiger-Mueller tubes have been successful in monitoring the above-referenced and other radiation events, their performance tended to degrade at elevated temperatures. One technique for conditioning Geiger-Mueller tubes to operate at higher temperatures was described in U.S. Pat. No. 3,342,538 in which an oxygen plasma was utilized to oxidize the interior surface of the cathode during the manufacturing operation. In another technique described in U.S. Pat. No. 3,892,990, the interior surface of the cathode was coated with a thin layer of chromium, platinum, or a nickel-copper alloy. Of these coatings, the platinum produced the highest sensitivity to gamma radiation.

However, problems were encountered in adhering the platinum to the inner surface of the cathode. Further, the porosity of the platinum tended to permit the corrosive halogen gases to pass therethrough and attack the cathode. At higher temperatures, the halogen degradation of the cathode was accelerated.

U.S. Pat. No. 4,359,661 provided improved resistance to halogens by replacing the platinum coating with layers of chromium oxide and tungsten. Because tungsten is not amenable to plating, a sleeve of tungsten foil having edges and seams was fashioned into a liner for the cathode. The gaseous mixture confined in the cathode chamber tended to migrate between the tungsten foil and the cathode causing partial delamination and degradation of the tube performance. Moreover, the greater thickness of tungsten foil relative to plated platinum, tended to reduce the relative performance characteristics of the tube.

The present invention provides a new and improved radiation detector which overcomes the above-referenced problems and others, yet provides excellent radiation detection characteristics.

SUMMARY OF THE INVENTION

In accordance with one aspect of the present invention, an improved radiation detector is provided. An interior surface of a tubular cathode is coated with a thin layer of rhenium. The ends of the cathode are sealed to define a sealed interior chamber. An anode extends through the sealed chamber in a spaced relationship with the cathode. A gas mixture including a minor quench gas component, preferably a halogen gas, is confined in the sealed chamber.

In accordance with a more limited aspect of the present invention, rhenium is plated onto the interior surface of the cathode to form a layer which is about $2\frac{1}{2}$ to 15 microns thick and the quench gas component includes about $\frac{1}{2}$ to 5% bromine.

In accordance with another aspect of the present invention, a method of detecting radiation is provided. An interior surface of a stainless steel tube is plated with a thin layer of rhenium. A conductive element is extended longitudinally through the tube in a spaced relationship therewith. Ends of the tube are sealed to define a chamber therein, which chamber is charged with a gaseous mixture that is about $\frac{1}{2}$ to 5% bromine. An electrical potential is applied across the tube and the conductive element such that the tube is biased as a cathode and the conductive element is biased as a anode. Electrical discharges between the cathode and anode caused by ionizing radiation are monitored.

A primary advantage of the present invention is that it provides a detector tube which is stable against bromine and other halogens at elevated temperatures.

Another advantage of the present invention is that its output characteristics are substantially constant over a wide range of temperatures.

Another advantage of the present invention is that it is relatively inexpensive to manufacture. The components are cheaper than platinum plated cathode Geiger-Mueller tubes and the production techniques are less elaborate than the tungsten-lined cathode Geiger-Mueller tubes.

Yet another advantage of the present invention is that it is not detrimentally affected by vibration.

Still further advantages of the present invention will become apparent to those of ordinary skill in the art upon reading and understanding the following detailed description of the preferred embodiment.

BRIEF DESCRIPTION OF THE DRAWINGS

The invention may take form in various parts or steps and in various arrangements of parts or steps. The figures are only for purposes of illustrating a preferred embodiment and are not to be construed as limiting the invention. Wherein the figures show.

DETAILED DESCRIPTION OF THE PREFERRED EMBODIMENT

Figure 1:
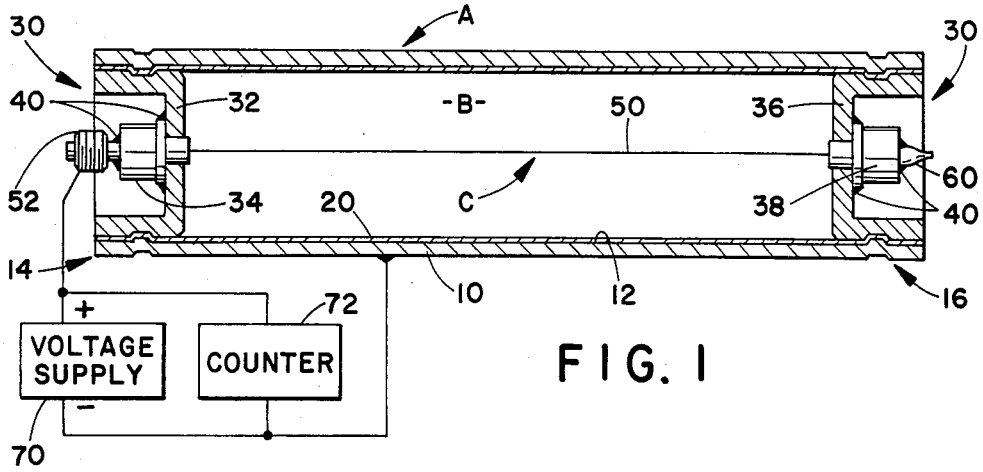
FIG. 1 is an elevational view in partial section of a Geiger-Mueller tube in accordance with the present invention.

With reference to FIG. 1, a Geiger-Mueller tube includes a rhenium plated tubular cathode A that defines a sealed chamber B therein. An anode C extends axially through the cathode chamber B and is surrounded by ionizable gas. The cathode A includes a type 446 stainless steel sleeve 10. The cathode sleeve defines an interior surface 12, a first end 14, and a second end 16.

A thin rhenium layer 20 coats the cathode sleeve interior surface 12. The rhenium layer defines an electrically conductive cathode surface, a halogen barrier to protect the stainless steel, and enhances the tube sensitivity because of the high atomic number of rhenium. The rhenium is plated onto the cathode interior surface such that the rhenium layer has a thickness in the range of 0.0001–0.0006 inches, i.e. 2½ to 15 microns, with 0.0003–0.0004 inches i.e. 7½ to 10 microns, being preferred, and having a weight distribution of about 15 milligrams per square centimeter. In FIG. 1, the thickness of the rhenium layer is exaggerated relative to the thickness of the stainless steel sleeve for simplicity of illustration.

In manufacture, the rhenium is plated directly on the stainless sleeve. No intermediate coatings are required. Before plating, the cathode is etched for about 45 seconds in 50% hydrochloric acid. After rinsing in distilled water, the inner surface is plated in a plating solution to an average thickness of 15 milligrams per square centimeter. The plating solution includes 50 grams of $NaReO_4$, 100 grams $(NH_4)_2SO_4$ and two grams of $H_2SO_4$ per liter of distilled water. The plating is carried out at about 65° C.

A sealing means 30 hermetically seals the ends 14, 16 of the cathode sleeve. In the illustrated embodiment, the sealing means includes a first metallic end cap 32 which is hermetically sealed to the cathode interior surface by adhesives, crimping, or the like. A first ceramic fitting 34 is mounted to the center of the first end cap. The sealing means further includes a second end cap 36 hermetically sealed to the cathode sleeve and a second ceramic fitting 38 disposed axially relative to the cathode sleeve. Glass solder beads 40 provide a hermetic seal between the end caps and the ceramic fittings and between the ceramic fittings and associated structures. In this manner, the cathode sleeve and the sealing means define the sealed chamber B therein.

The anode C includes an electrically conductive wire 50 extending axially through the sealed chamber B in a spaced relationship with the cathode A. The anode wire is mounted taut between the first and second ceramic fittings 34, 38. At one end, the anode wire 50 is interconnected with an electrical fitting 52 which is mounted in the ceramic fitting.

A sealable tube 60 provides a passage into the sealed chamber B for selectively evacuating and charging the sealed chamber with a gaseous mixture. The gaseous mixture includes a primary component of inert gases and a minor component of halogen quenching gases. Preferably, the inert gases are a mixture of neon and argon. The quenching gas component includes about ½ to 5% bromine, with 1–3% being preferred. Optionally, chlorine and other halogens may find utility for some applications. After the chamber B is charged with the selected gaseous mixture, the passage 60 is fused closed such that the interior chamber is sealed.

A voltage source 70 is connected between the cathode sleeve 10 and the electrical fitting 52 in order to bias the stainless sleeve 10 as a cathode and the wire 50 as an anode. A counter 72 is interconnected with the cathode and anode to count the discharges between the anode and cathode caused by ionization of the gaseous mixture therebetween.

Figure 2:
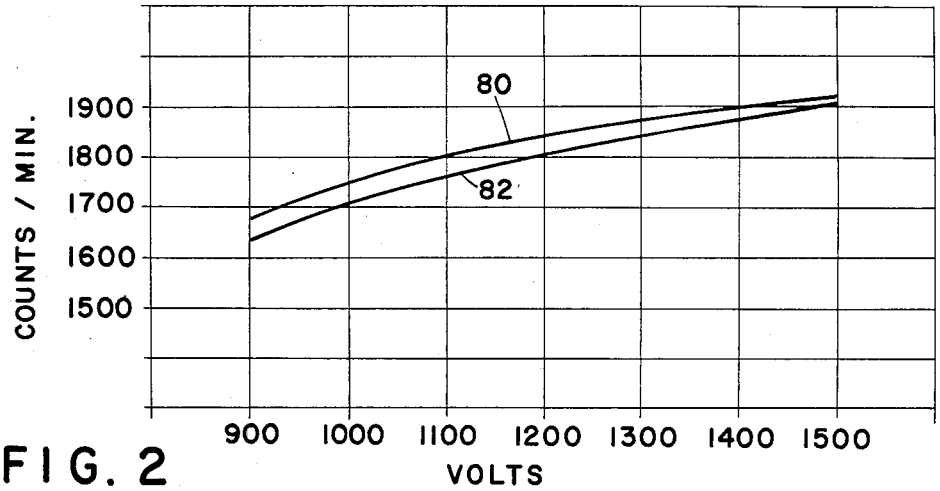
FIG. 2 is a graphic representation of the relative performance characteristics of the present invention at room temperature and at 200° C.; and, FIG. 3 is a graphic representation of the relative performance characteristics of the present invention and a platinum plated cathode at room temperature when responding to a cobalt 60 radiation source.

With reference to FIG. 2, curve 80 illustrates the performance characteristics at room temperature. Specifically, curve 80 shows the relationship between operating potential and detected events, specifically per minute at room temperature. Curve 82 illustrates the relationship between operating potential and counts per minute at 200° C. It is to be noted that the output response varies only about 2% between room temperature and 200° C. That is, the operating characteristics are substantially temperature independent.

Figure 3:
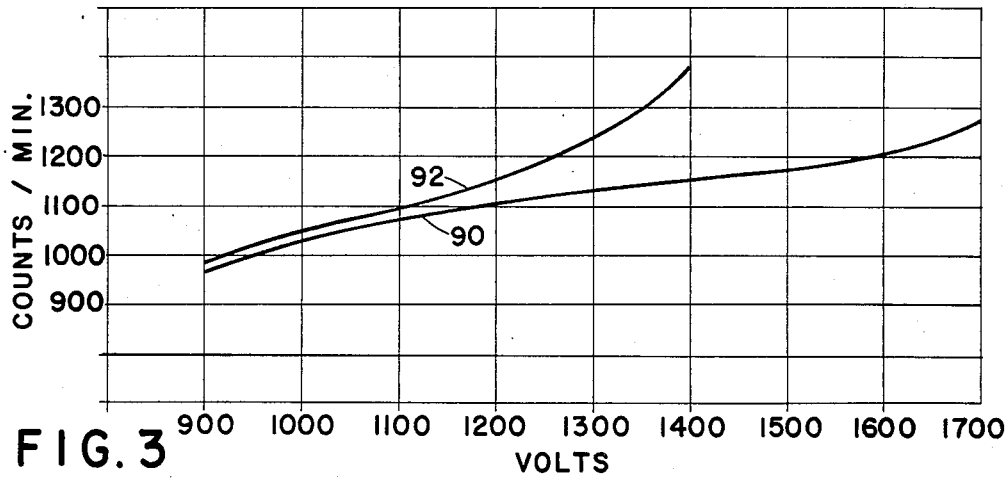

With reference to FIG. 3, the operating characteristics of a rhenium plated cathode at curve 90 are compared to the characteristics of a platinum plated cathode at curve 92. Specifically, the counts per minute at various operating voltages when radiated by gamma radiation from the same source of cobalt 60 are shown. The rhenium plated cathode of the present invention achieves a substantially linear plateau over a range of about 800 volts, from an operating voltage of about 900 to 1700 volts. The prior art platinum plated cathode achieved a linear operating range of only about 300 volts from about 900 to 1200 operating volts.

Thus, the present invention provides substantially linear performance characteristics which are relatively unaltered by temperature variation and over a wide range of operating voltages.

The invention has been described with reference to the preferred embodiment. Obviously, modifications and alterations will become apparent to those of ordinary skill in the art upon reading and understanding the preceeding specification. It is intended that the invention be construed as including all such alterations and modifications in so far as they come within the scope of the appended claims or the equivalents thereof.

Having thus described a preferred embodiment, the invention is now claimed to be:

1. A Geiger-Mueller radiation detector comprising:

a cathode including a cylindrical sleeve of stainless steel having a first end, a second end, and an interior surface;

a thin layer of rhenium plated on the cathode interior surface;

an anode extending longitudinally through the cathode in a spaced relationship thereto;

a gaseous mixture disposed between the cathode and the anode, the gaseous mixture including a primary component of inert gas and a minor component of halogen gas.

2. The detector as set forth in claim 1 wherein the primary gaseous component includes a mixture of neon and argon and the minor component includes about 0.5 to 5% bromine.

3. The detector as set forth in claim 1 wherein the gaseous mixture is 1 to 3% bromine.

4. The detector as set forth in claim 1 wherein the rhenium is plated with an average thickness of about 15 $mg/cm^2$.

5. The detector as set forth in claim 1 wherein the rhenium is less than 15 microns thick.

6. The detector as set forth in claim 5 wherein the rhenium is about $7\frac{1}{2}$ microns thick.

7. A method detecting radiation comprising:

plating an interior surface of a stainless steel sleeve with a thin coating of rhenium;

extending a single conductive element longitudinally through the sleeve in a spaced relationship therewith to define a screen-free void between the conductive element and the sleeve;

sealing the sleeve adjacent ends thereof without inserting a screen to define a sealed screen-free chamber therein;

charging the chamber with a gaseous mixture including a primary component of inert gas and a minor component of halogen gas;

applying an electrical potential across the sleeve and the conductive element such that the sleeve is biased as a cathode and the conductive element is biased as an anode;

monitoring for electrical discharges between the cathode and anode resulting from radiation caused ionization of gas in the gaseous mixture.

8. The method as set forth in claim 7 wherein the rhenium is plated with an average thickness of about 15 milligrams per square centimeter.

9. The method as set forth in claim 7 wherein the gaseous mixture is about 0.5 to 5% bromine.

10. A radiation detector comprising:

a stainless steel sleeve which is coated seamlessly with a coating of rhenium with a thickness of about 15 $mg/cm^2$ to define a screen-free inner cathode surface;

means for hermetically sealing the sleeve to define a hermetically sealed chamber in the interior thereof;

an anode extending longitudinally through the sealed chamber in a space relationship with the cathode surface;

a gaseous mixture which is at least 95% inert gas and less than 5% bromine quench gas.

* * * * *